US011883755B2

(12) United States Patent
Bishop

(10) Patent No.: US 11,883,755 B2
(45) Date of Patent: Jan. 30, 2024

(54) AUTOMATIC WHEELCHAIR ACCESSIBLE SEE-SAW

(71) Applicant: Troy Andrew Bishop, Felton, DE (US)

(72) Inventor: Troy Andrew Bishop, Felton, DE (US)

( * ) Notice: Subject to any disclaimer, the term of this patent is extended or adjusted under 35 U.S.C. 154(b) by 94 days.

(21) Appl. No.: 17/576,453

(22) Filed: Jan. 14, 2022

(65) Prior Publication Data

US 2023/0226457 A1 Jul. 20, 2023

(51) Int. Cl.
*A63G 11/00* (2006.01)
*A63G 9/00* (2006.01)

(52) U.S. Cl.
CPC ..... *A63G 11/00* (2013.01)

(58) Field of Classification Search
CPC ..... A63G 7/00; A63G 9/00; A63G 11/00
USPC ..... 472/1, 3, 106, 107
See application file for complete search history.

(56) References Cited

U.S. PATENT DOCUMENTS 5,676,601 A * 10/1997 Saunders ..... A63G 1/32 472/3
5,935,011 A * 8/1999 Morgan ..... A63G 4/00 472/36
5,938,283 A * 8/1999 Babcock ..... A47C 3/0255 297/278
5,951,406 A 9/1999 Steane
6,929,553 B1 * 8/2005 Diemert ..... A63G 9/00 472/121

OTHER PUBLICATIONS

Universal Design Style, "Accessible Wheelchair See Saw", downloaded at http://www.universaldesignstyle.com/accessible-wheelchair-see-saw, 2014, 8 pages.

* cited by examiner

*Primary Examiner* — Kien T Nguyen
(74) *Attorney, Agent, or Firm* — RatnerPrestia

(57) ABSTRACT

A see-saw apparatus includes a base, a beam, a first and second carrier platform, at least one actuator, and an actuator control device. The beam, with a first and a second end, pivotally attaches to the base at a fulcrum between the first and second end. The first carrier platform couples to the first end and is configured to receive a wheelchair. The second carrier platform couples to the second end and is configured to receive a wheelchair. The at least one actuator is coupled to the beam and the base, and is configured to cause the beam to pivot between a first and a second position. The first position defines a limit of travel in a first pivotal direction, and the second position defines a limit of travel in a second pivotal direction opposite the first pivotal direction. The actuator control device couples to the at least one actuator.

9 Claims, 6 Drawing Sheets

AUTOMATIC WHEELCHAIR ACCESSIBLE SEE-SAW

TECHNICAL FIELD

The present subject matter relates to childhood development and entertainment equipment, such as a see-saw, teeter-totter, or teeterboard. More particularly, to a see-saw with one or more actuators, capable of elevating and lowering children in wheelchairs.

BACKGROUND

See-saws are a fixture in the collective consciousness as emblematic of a children's playground. Two children partner up and sit at opposite ends of a beam on a fulcrum, in order to propel themselves upward while sending their opposing partner downward. Traditionally, see-saws require and improve physical coordination and strength as a child moves their end of the see-saw upward. Rapidly moving a child through vertical space provides input to the child's vestibular balance regulation system in a way that other playground equipment does not.

Additionally, see-saws improve the emotional and physical regulation of children: see-saws necessitate coordination, and their simple design places to children front and center the limited components needed to have fun with a see-saw: a pivot, a board, and another amenable child. As opposed to complicated contemporary childhood development tools, such as a electronic tablet or smartphone, a child using a see-saw can see all of the moving components of the see-saw, and can quickly ascertain that it is not the pivot and not the board stopping any fun: it is another child (or lack thereof), or themselves. Children learn altruistic behavior, as well as learning the fact that altruistic behavior and following the rules of the see-saw can directly benefit them. The social contract required to use a see-saw also allows children to explore breaking social contracts, and results in children learning advanced social strategy and game theory, all outside of a classroom.

Children who use wheelchairs have similar developmental needs as children who do not use wheelchairs. Though children who use wheelchairs may not have enough leg strength to propel themselves and another cantilevered child on a see-saw, these children still benefit from the improved balance regulation, as well as the socialization inherent in the use of a see-saw. These children, in particular children with cerebral palsy, may also not have enough arm strength to pull or push themselves on a modified see-saw implementing fixed grab bars.

SUMMARY OF THE INVENTION

Hence, there is need in the art of see-saws for improvement to allow children in wheelchairs to derive the benefits that children not using wheelchairs experience from using a traditional see-saw. The see-saw apparatus disclosed herein allows a child or children who use wheelchairs to utilize and enjoy the benefits of a traditional see-saw, in particular even if those children who use wheelchairs lack the body strength to utilize a traditional see-saw, or a see-saw motivated by upper-body strength and grab bars.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

One or more specific examples of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments.

The term "coupled" as used herein refers to any logical, optical, physical or electrical connection, link or the like by which signals or light produced or supplied by one system element are imparted to another coupled element. Unless described otherwise, coupled elements or devices are not necessarily directly connected to one another and may be separated by intermediate components, elements or communication media that may modify, manipulate, or carry the forces or signals.

The calculations required to determine how much force at least one actuator needs to generate in order to pivot the beam can be determined in part according to the equation $F_e=(F_l*d_l)/d_e$, where $F_e$=lever effort force, $F_l$=load force, $d_l$=distance from load force to fulcrum, and $d_e$=distance from effort force to fulcrum.

Reference now is made in detail to the examples illustrated in the accompanying drawings and discussed below.

Figure 1:
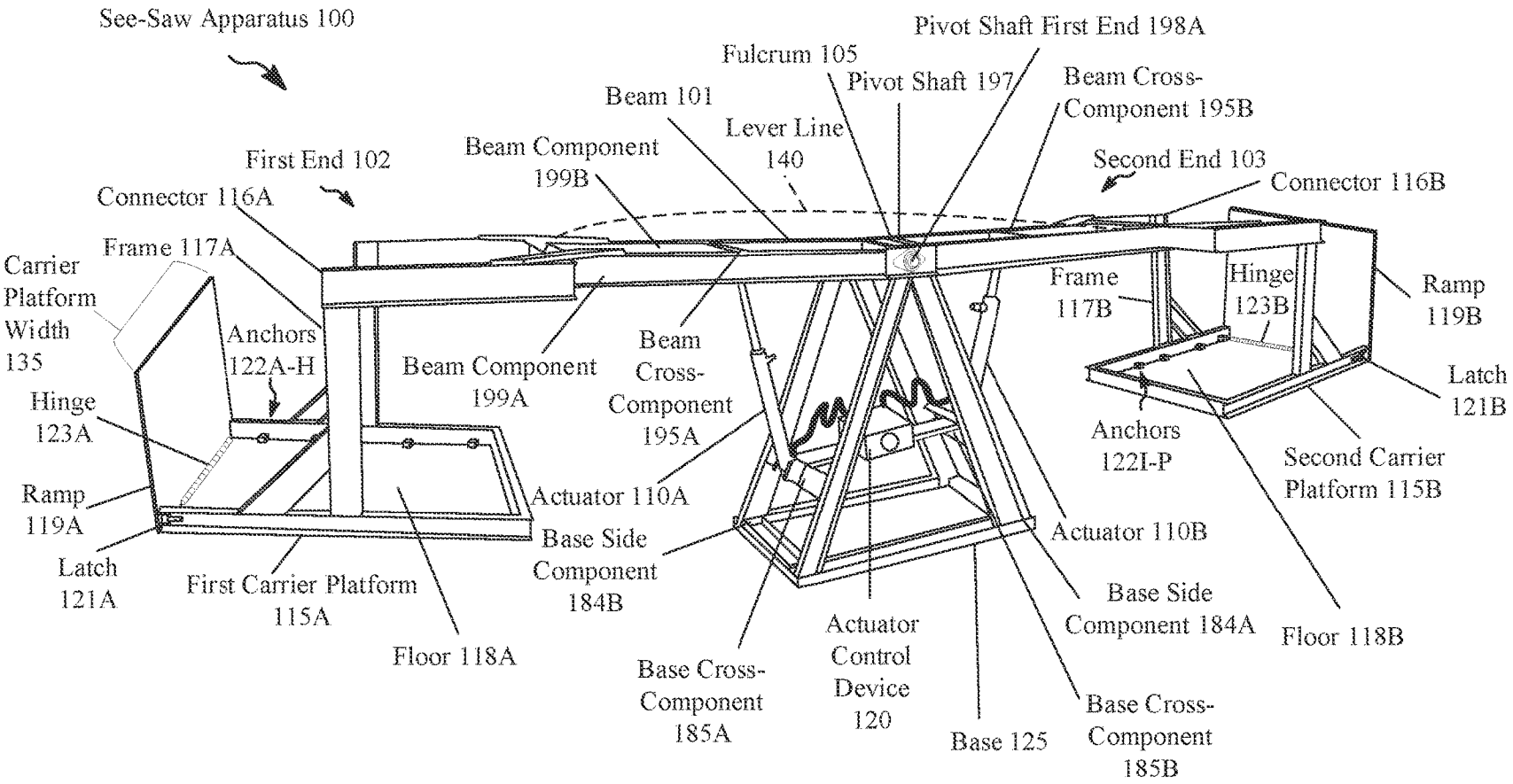
FIG. 1 is a side view blackline illustration of a see-saw apparatus implementing a first and second carrier platform as well as a two actuators.

FIG. 1 is a side view blackline illustration of a see-saw apparatus 100 implementing a first carrier platform 115A and second carrier platform 115B as well as actuators 110A-B. The see-saw apparatus 100 includes a beam 101 attached to a fulcrum 105 or pivot. The beam 101 is preferably made of metal, and extends from the fulcrum 105 toward a first lever end 102. The beam 101 also extends in the opposite direction from the fulcrum 105 toward a second end 103. The beam 101 is constructed with one or more beam components 199A-B, the beam components 199A-B extending from the first end 102 to the second end 103. Several cross braces or beam cross-components 195A-B connect one beam component 199A to the other beam component 199B to improve the stability of the beam 101 and the see-saw apparatus 100. The beam components 199A-B can be split into one or more sub-beam components; in particular a beam component 199A can be divided into a first sub-beam component between the first end 102 and the fulcrum 105, and a second sub-beam component between the second end 103 and the fulcrum 105. Alternatively, the beam 101 can be made of a single beam component 199A, capable of supporting both the first carrier platform 115A and the second carrier platform 115B across the fulcrum 105. The beam 101 has a lever line 140 running from the first end 102 to the second end 103. The roll axis of the beam 101 extends along the lever line 140, the pitch axis of the beam 101 is perpendicular to the beam 101 and parallel to the fulcrum 105, and the yaw axis of the lever is perpendicular to the fulcrum 105 and pointed toward the ground.

The see-saw apparatus 100 includes a pivot shaft 197 coupled to the beam 101 and the base 125 at the fulcrum 105. The base 125 is wide enough to reduce yaw or roll vibration experienced by the beam 101, and the base 125 may be affixed to the ground. The base 125 comprises two base side components 184A-B, and the base side components 184A-B are connected to each other by several base cross-components 185A-B. In this example, the base cross components 185A-B are approximately as wide as the beam cross components 195A-B, and add stability to the base 125. The base 125 and the subcomponents of the base 125 including the base side components 184A-B and the base cross-components 185A-B are also preferably made of metal. The base side components 184A-B are preferably welded to the base cross components 185A-B to form the base 125. The base 125 is sufficiently tall to allow both the first carrier platform 115A and the second carrier platform 115B to be elevated to a desired maximum height enjoyable by one or more children. For example, if a child who uses a wheelchair should be elevated three feet off the ground, and the first carrier platform 115A hangs three feet below the first carrier connector 116A, then the base 125 will be at least 4.5 feet tall. The height of the base 125 is preferably determined by (distance between first carrier connector 116A and first carrier platform 115A+0.5*desired maximum height).

The pivot shaft 197 allows the pitch of the beam 101 to be adjusted, allowing the beam 101 to pivot between a first position 150 (see FIG. 2A) and a second position 151 (see FIG. 2C), with the first position 150 defining a limit of travel in a first pivotal direction and the second position defining a limit of travel in a second pivotal direction opposite the first pivotal direction.

The first carrier platform 115A is connected to the first end 102 by a connector 116A, and the second carrier platform 115B is connected to the second end 103 by a connector 116B. The connectors 116A-B are bearing assemblies or pins, connecting the frames 117A-B to the beam 101. Preferably, the connectors 116A-B allow the first carrier platform 115A and second carrier platform 115B to freely adjust their respective pitches based upon gravity, resulting in the first carrier platform 115A and second carrier platform 115B remaining level to the ground as the beam 101 adjusts pitch and elevates and lowers the first carrier platform 115A and second carrier platform 115B. The connectors 116A-B may include stops preventing the first carrier platform 115A and second carrier platform 115B from rotating too far about their pitch axes, thereby preventing children using wheelchairs from inadvertently falling out the open ends of the first carrier platform 115A and the second carrier platform 115B. Alternatively, the connectors 116A-B may not rotate, and therefore do not allow the first carrier platform 115A and the second carrier platform 115B to self-level relative to the ground. In such an example, the pitch of the first carrier platform 115A and the second carrier platform 115B would be equal to the pitch of beam 101.

The first carrier platform 115A and the second carrier platform 115B have floor 118A-B, which may be constructed of, e.g., metal deck plate, to reduce the slipping of children using wheelchairs while the see-saw apparatus 100 is in use. The floors 118A-B are affixed to the frames 117A-B via a weld or a fixed bolt. The first carrier platform 115A, the second carrier platform 115B, the floors 118A-B, frames 117A-B, and connectors 116A-B are preferably made of metal. The floors 118A-B can include anchor points 122A-P, through which anchoring straps can be fed. The anchoring straps can attach to a wheelchair, safely securing the wheelchair within the first carrier platform 115A or the second carrier platform 115B. The back of the first carrier platform 115A and the second carrier platform 115B may have ramps 119A-B, connected to the floors 118A-B via hinges 123A-B. The hinges 123A-B in this example are piano or continuous hinges, and connect the ramp 119A to the floor 119B, as well as the ramp 119B to the floor 118B. The ramps 118A-B are preferably made of the same material as the floors 118A-B e.g., metal deck plate, and allow children using wheelchairs to access the first carrier platform 115A and the second carrier platform 115B, particularly in examples where the first carrier platform 115A and the second carrier platform 115B do not directly come in contact with the ground. The ramps 119A-B of FIG. 1 are depicted in an elevated position: when children using wheelchairs are entering or exiting the see-saw apparatus 100, the ramps 119A-B are pivoted on their respective hinges 123A-B, lower, and the far end of the ramps 119A-B not in contact with the hinges 123A-B come in contact with the ground. Once a child using a wheelchair has entered the first carrier platform 115A or the second carrier platform 115B via the ramps 119A-B, the ramps 119A-B are elevated, and secured in their vertical position via latches 121A-B.

The latches 121A-B in this example are designed to secure the ramps 119A-B in their vertical position, and are not deliberately designed be strong enough to prevent a child using a wheelchair from inadvertently lowering the ramp 119A by moving backwards. However, latches 121A-B strong enough to secure both the ramps 119A-B as well as children using wheelchairs are contemplated: in related examples, the ramps 119A-B may have additional connection points or latches near the connectors 116A-B or the frames 117A-B to further secure the ramps 119A-B. The beam components 199A-B may extend past the connectors 116A-B, away from the fulcrum 105, in order to line up vertically with the back of the first carrier platform 115A and the second carrier platform 115B—the non-hinged end of the ramps 119A-B would then connect to the extended portion of the beam components 199A-B.

The first carrier platform 115A hovers approximately two inches above the ground, ramp is deployed allowing access the ground via the ramps 119A-B when lowered by the beam 101, and allows a child using a wheelchair to enter or exit the first carrier platform 115A. The second carrier platform 115B behaves in a similar manner. The first carrier platform 115A and the second carrier platform 115B have a carrier platform width 135 wide enough to accommodate a wheel chair: most wheelchairs are between twenty-nine and thirty-two inches wide. The carrier platform width 135 is wider than the width a reasonable person is able to straddle across and sit upon. This wide platform width 135 means the first carrier platform 115A is not designed to be sat upon like a saddle, with the legs of a person extending below the floor 118A of the first carrier platform 115A. A person could sit or stand upon the first carrier platform 115A or the second carrier platform 115B, but the carrier platform width 135 is too wide for a person to straddle the first carrier platform 115A or the second carrier platform 115B.

The first carrier platform 115A and the second carrier platform 115B may have a bar or gate extending along the back of the first carrier platform 115A and the second carrier platform 115B to prevent a child using a wheelchair from inadvertently exiting from the back of the first carrier platform 115A or the second carrier platform 115B. This bar or gate may work in concert with the ramps 119A-B and latches 121A-B.

The pitch of the beam 101 is changed by an actuator 110A-B, or two actuators 110A-B acting in concert. The actuators 110A-B in this example are linear actuators, however actuators suitable for use in conjunction with the invention may be any type of actuator capable of moving the beam 101, such as, e.g., rotary actuators disposed to cause relative motion between the pivot shaft and the base. The actuators 110A-B may be motivated by electric current, hydraulic pressure, or pneumatic pressure, and therefore may be electric actuators, hydraulic actuators, or pneumatic actuators. In examples with two opposing actuators 110A-B, the two actuators 110A-B work in concert: the actuator 110A will extend while the actuator 110B retracts. The actuators 110A-B may actively retract, as opposed to passively permitting retraction, to increase a downward force on the beam 101. The actuators 110A-B have one end coupled to the base 125, preferably on the base cross-components 185A-B, and the actuators 110A-B have another end coupled to the beam 101, preferably on the beam cross-components 195A-B. The end of the actuator 110A coupled to the beam 101 is coupled between the fulcrum 105 and the first end 102, and the end of the actuator 110B coupled to the beam 101 is coupled between the fulcrum and the second end 103.

The force of the actuators 110A-B can be adaptive, and responsive to the masses within the first carrier platform force 117A and the second carrier platform force 117B. Alternatively, the force of the actuators 110A-B can be set to values designed to move the see-saw apparatus 100 safely and entertainingly based on expected reasonable masses present on the first carrier platform 115A and the second carrier platform 115B.

The actuators 110A-B are controlled by an actuator control device 120. The actuator control device 120 sends control signals 170 (e.g. electrical, mechanical, or electromechanical) conforming to the signal type expected by the actuators 110A-B; e.g. if the actuator 110A expects a pneumatic signal, then the actuator control device 120 sends a pneumatic signal of pneumatic pressure, forcing the actuator 110A to extend. The actuator control device 120 may be a simple mechanical or electromechanical device, transmitting signals or changing pneumatic or hydraulic pressure in response to mechanical button presses. However, the actuator control device 120 may include a processor, memory, and programming to allow for complex behavior in response to sensors. In this example, the actuator control device 120 is mounted on a sub-beam spanning between the two base cross-components 185A-B. However, the actuator control device could be located anywhere that the actuators 110A-B can receive control signals 170.

The complex behavior may include timers, dynamic speed regulation, and a safety protocol to safely lower children who use wheelchairs riding on the first carrier platform 115A or the second carrier platform 115B. The complex behavior may further include having a reduced limit of travel in the first pivotal direction 250A (see FIG. 2C) or the second pivotal direction 250B (see FIG. 2A). For example, when in a "loading/unloading" phase during loading and unloading riders in wheelchairs, the apparatus may adopt positions in which the first carrier platform 115A or second carrier platform 115B are in contact with the ground surface. The apparatus may then adopt a "running phase" in which the see-saw apparatus 100 may cycle between positions in which the first carrier platform 115A or the second carrier platform 115B are stopped close to but before making contact with the ground surface as the respective carrier platforms transition from downward to upward movement.

The actuator control device 120 may be powered by electricity, or may have a reserve of pressurized pneumatic or hydraulic fluid which is periodically replenished. The actuator control device 120 may also incorporate some type of internal combustion engine, and either directly use the mechanical output of the internal combustion engine to power or control the actuators 110A-B, or may convert the mechanical output of the internal combustion engine into electrical output to either power or control the actuators 110A-B, or to power any electrical components such as a processor or memory within the actuator control device 120. The actuator control device 120 sends signals to expand or contract the actuators 110A-B. In this example, the actuator device 120 is configured to cause simultaneous retraction of the actuator 110A and extension of the actuator 110B to cause the beam 101 to pivot in a first pivotal direction 250A (see FIG. 2C), moving the see-saw apparatus 100 toward the first position 150, and is configured to cause simultaneous extension of the actuator 110A and retraction of the actuator 110B to cause the beam 101 to pivot in a second pivotal direction 250B (see FIG. 2A), moving the see-saw apparatus 100 toward the second position 151.

The intended forces and movement of the see-saw apparatus 100 primarily affect the pitch of the beam 101, first carrier platform 115A, and the second carrier platform 115B. A side view diagram is sufficient to describe relevant moments of the see-saw apparatus 100. Secondary effects to the yaw and roll of the beam 101, first carrier platform 115A, and second carrier platform 115B are incidental, and preferably are minimized.

Figure 2A:
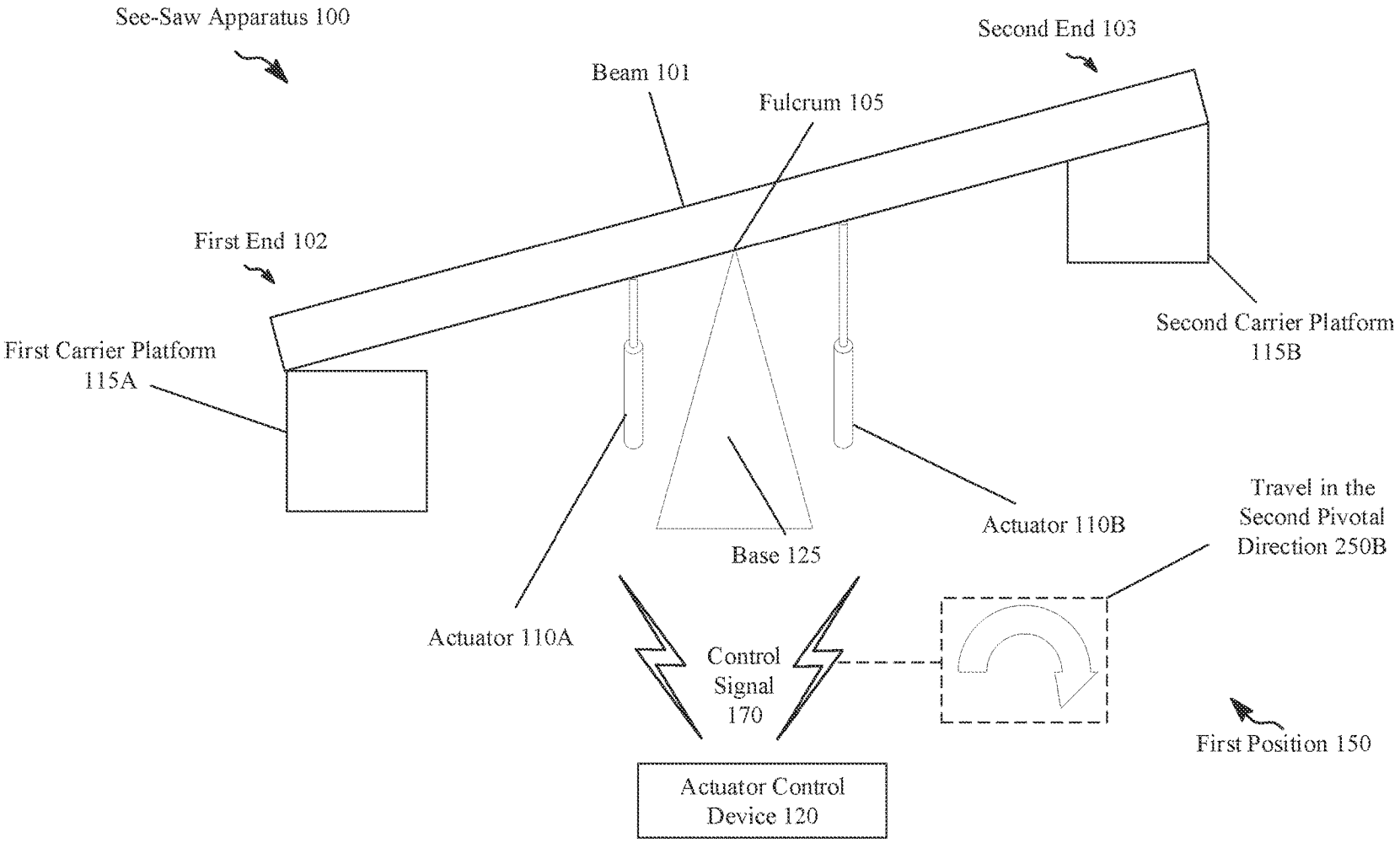
FIG. 2A is a diagram of the see-saw apparatus in the first position.
Figure 2B:
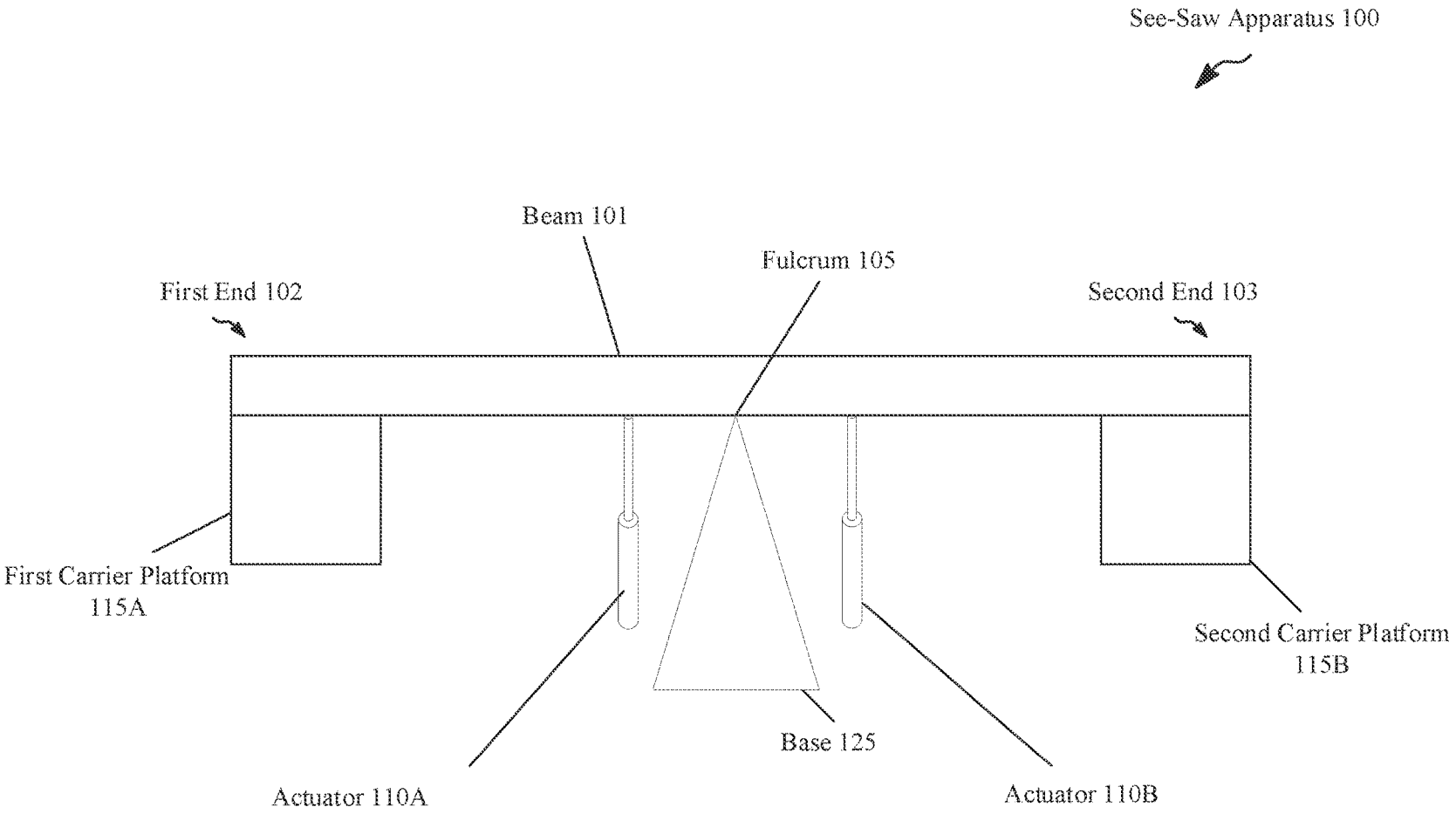
FIG. 2B is a diagram of the see-saw apparatus in an equilibrium position.
Figure 2C:
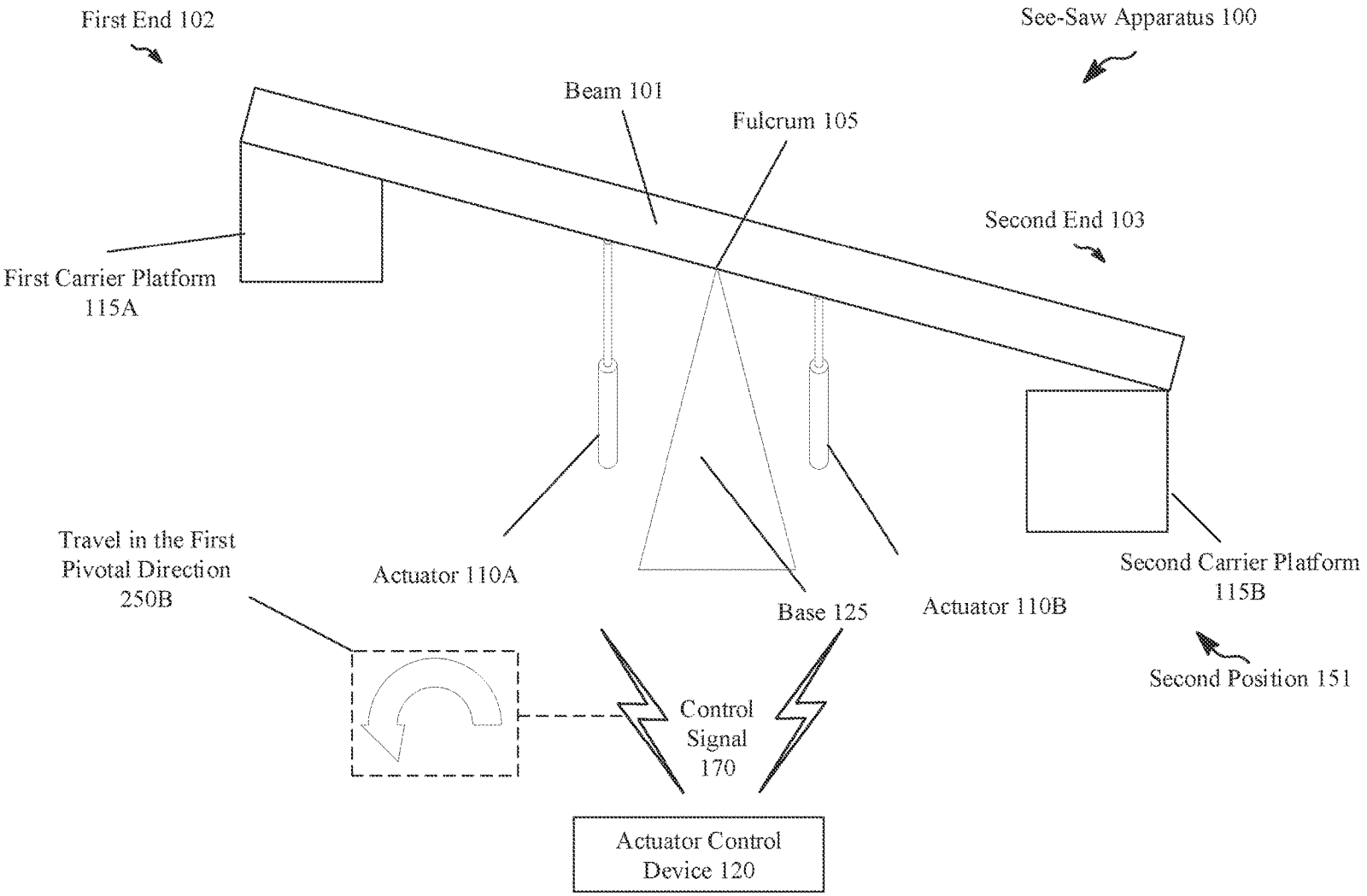
FIG. 2C is a diagram of the see-saw apparatus in the second position.

FIGS. 2A-C are a series of diagrams depicting the see-saw apparatus 100 in a first position 150, an equilibrium position, and a second position 151. FIG. 2A is a diagram of the see-saw apparatus 100 in the first position 150. In this first position 150, a child using a wheelchair can embark or exit the first carrier platform 115A. This loading and unloading first position 150 defines a limit of travel in the first pivotal direction 250A (see FIG. 2C)—the first carrier platform 115A floor 118A is in planar alignment and hovers above the surface of the ground, and can go no further downward.

In order to facilitate loading and to reduce jittering of the see-saw apparatus 100 as a child using a wheelchair embarks or exits the first carrier platform 115A or the second carrier platform 115B, the actuators 110A-B may apply force to increase the downward pressure on the first carrier platform 115A or the second carrier platform 115B. In this example, as the first carrier platform 115A is loading (or unloading), the actuator 110B applies force upward by extending, pushing force across the fulcrum 105 and thereby pushing the first carrier platform 115A down. The actuator 110A applies force by contracting, compressing, or retracting the actuator 110A. In the preferred example, the first carrier platform 115A and the second carrier platform 115B hover above the ground when children using wheelchairs enter and exit the first carrier platform 115A or second carrier platform 115B. However, in some examples the floors 118A-B of the first carrier platform 115A or the second carrier platform 115B may come into contact with the ground. Such contact may be incidental, or alternatively may be desired. When contact of the floors 118A-B to the ground is desired, Sufficient force from the actuators 110A-B may firmly press the first carrier platform 115A into the ground, even if the second carrier platform 115B is loaded with a child using a wheelchair. The force exerted in this situation may be selected so as to be less than a force that will cause any portion of the base to lift from the ground.

This figure also depicts the actuator control device 120 transmitting a control signal 170 to the actuators 110A-B to move the beam 101 of the see-saw apparatus 100. In particular, this control signal 170 is directing the actuators 110A-B to facilitate travel in the second pivotal direction 250B. Therefore, the actuators 110A-B will move the beam from this first position 150, through the equilibrium position of FIG. 2B, to the second position 151 of FIG. 2C.

FIG. 2B is a diagram of the see-saw apparatus 100 in an equilibrium position. Coming from FIG. 2A, the control signal 170 has motivated the actuators 110A-B to begin elevating the first carrier platform 115A and lowering the second carrier platform 115B, thereby travelling in the second pivotal direction 250B. If, however, the equilibrium position was reached from the second position 151 of FIG. 2C, the control signal 170 shown in that figure has motivated the actuators 110A-B to begin lowering the first carrier platform 115A and elevating the second carrier platform 115B, thereby travelling in the first pivotal direction 250A.

FIG. 2C is a diagram of the see-saw apparatus 100 in the second position 151. In this second position 151, a child using a wheelchair can embark or exit the second carrier platform 115B. This loading and unloading second position 151 defines a limit of travel in the second pivotal direction 250B—the second carrier platform 115B floor 118B is in planar alignment and hovers above the surface of the ground, and can go no further downward.

This figure also depicts the actuator control device 120 transmitting a control signal 170 to the actuators 110A-B to move the beam 101 of the see-saw apparatus 100. In particular, this control signal 170 is directing the actuators 110A-B to facilitate travel in the first pivotal direction 250A. Therefore, the actuators 110A-B will move the beam from this second position 151, through the equilibrium position of FIG. 2B, to the first position 150 of FIG. 2A.

Figure 3A:
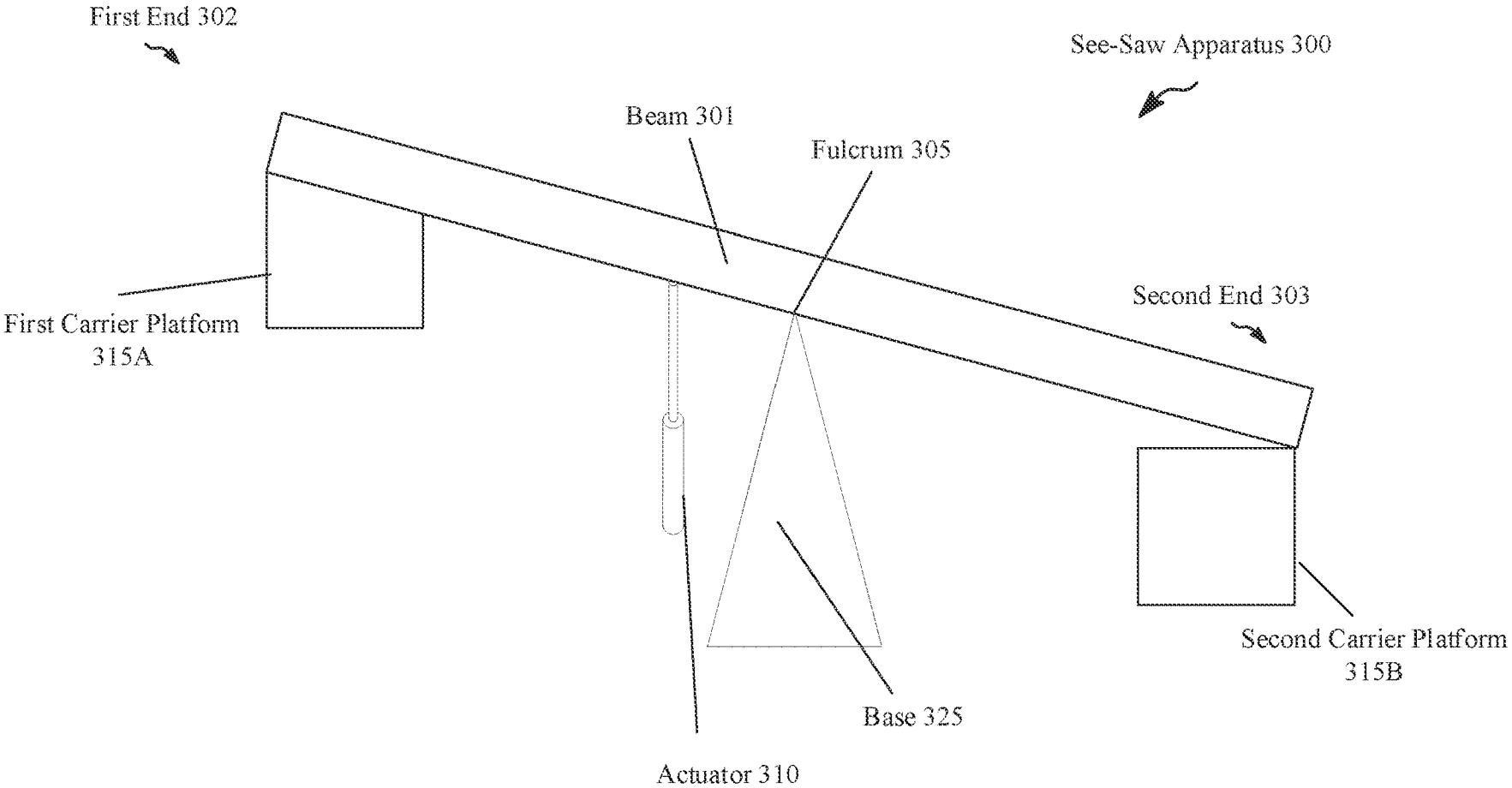
FIG. 3A is a diagram of a see-saw apparatus in the second position utilizing a single actuator toward the first end.

FIG. 3A is a diagram of a see-saw apparatus 300 utilizing a single actuator 310 toward a first end 302. In this example, the force of the actuator 310 must be substantially larger, approximately twice as large, to compensate for the fact that there is no second actuator. In examples where a second actuator (positioned similarly to actuator 110B in FIG. 2C) is present, but the second actuator is not capable of applying a retracting force, the actuator 310 when extending will need to apply force as depicted in this figure.

Figure 3B:
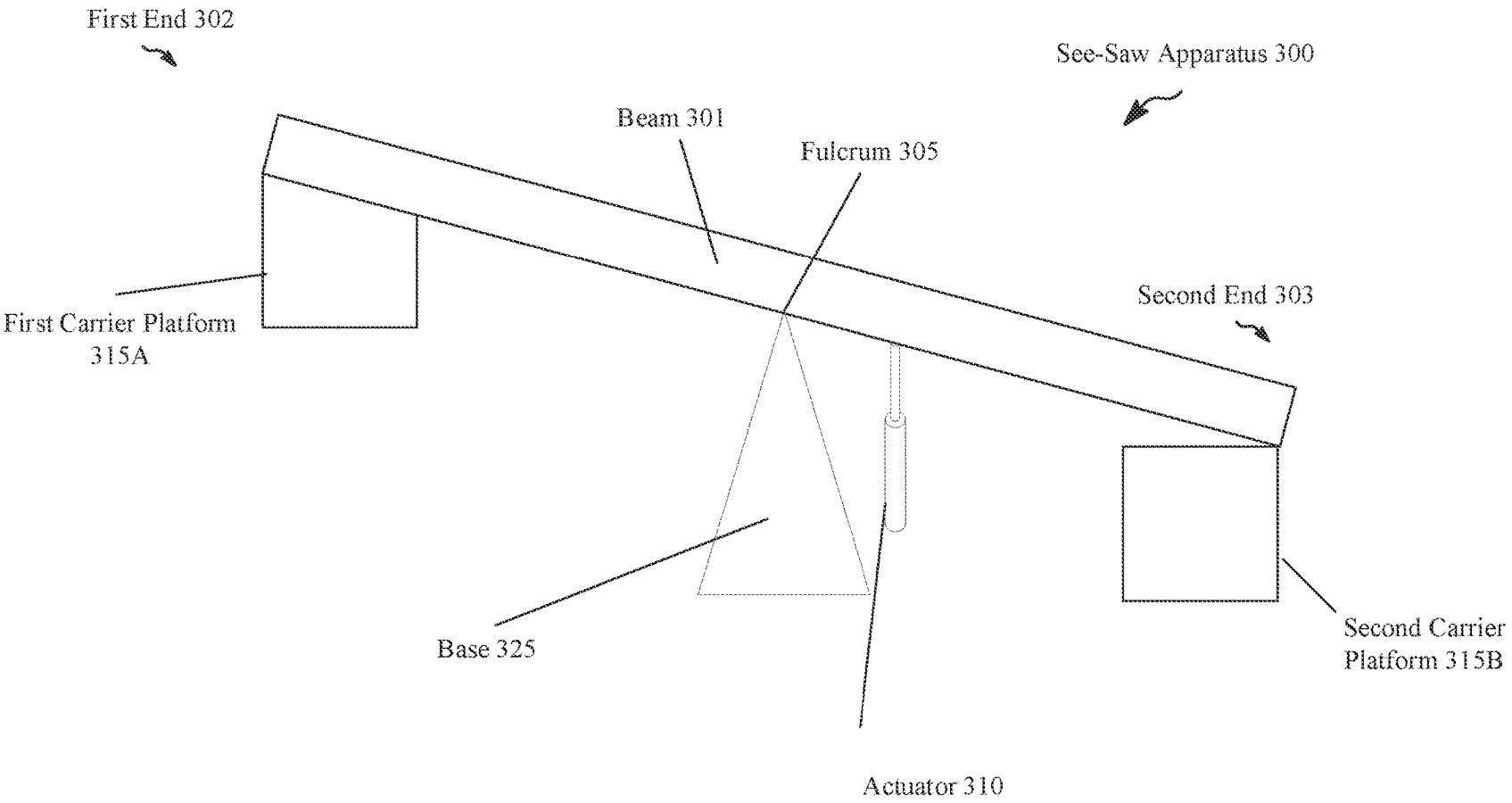
FIG. 3B is a diagram of a see-saw apparatus in the position utilizing a single actuator toward the second end.

FIG. 3B is a diagram of a see-saw apparatus 300 utilizing a single actuator 110A toward a second end 303. In this example, the force of the actuator 310 must be substantially larger, approximately twice as large, to compensate for the fact that there is no second actuator. In examples where a second actuator 110 (positioned similarly to actuator 110A in FIG. 2C) is present, but the second actuator is not capable of applying a retracting force, the actuator 310 when extending will need to apply force as depicted in this figure.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims. It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," "includes," "including," "containing," "contains," "having," "has," "with, or any other variation thereof, are intended to cover a non-exclusive inclusion, such that a process, method, article, or apparatus that comprises or includes a list of elements or steps does not include only those elements or steps but may include other elements or steps not expressly listed or inherent to such process, method, article, or apparatus. An element preceded by "a" or "an" does not, without further constraints, preclude the existence of additional identical elements in the process, method, article, or apparatus that comprises the element.

Unless otherwise stated, any and all measurements, values, ratings, positions, magnitudes, sizes, and other specifications that are set forth in this specification, including in the claims that follow, are approximate, not exact. Such amounts are intended to have a reasonable range that is consistent with the functions to which they relate and with what is customary in the art to which they pertain. For example, unless expressly stated otherwise, a parameter value or the like may vary by as much as ±10% from the stated amount. As used herein, the terms "substantially" or "approximately" mean the parameter value varies up to ±10% from the stated amount.

In addition, in the foregoing Detailed Description, it can be seen that various features are grouped together in various examples for the purpose of streamlining the disclosure. This method of disclosure is not to be interpreted as reflecting an intention that the claimed examples require more features than are expressly recited in each claim. Rather, as the following claims reflect, the subject matter to be protected lies in less than all features of any single disclosed example. Thus, the following claims are hereby incorporated into the Detailed Description, with each claim standing on its own as a separately claimed subject matter.

While only certain features have been illustrated and described herein, many modifications and changes will occur to those skilled in the art. It is, therefore, to be understood that the appended claims are intended to cover all such modifications and changes as fall within the true spirit of the disclosure. Additionally, features may be combined or used in tandem that appear in certain embodiments, even if those features are not explicitly depicted as being used with those embodiments.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present concepts.

The invention claimed is:

1. A see-saw apparatus, comprising:

a base;

a beam, having a first end and a second end, pivotally attached to the base at a fulcrum between the first end and the second end;

a first carrier platform, coupled to the first end of the beam, comprising a first frame pivotally coupled to the beam and a first floor affixed to the first frame, and configured to receive a wheelchair;

a second carrier platform, coupled to the second end of the beam, comprising a second frame pivotally coupled to the beam and a second floor affixed to the second frame, and configured to receive a wheelchair;

at least one actuator, coupled to the beam and the base, and configured to cause the beam to pivot between a first position and a second position, the first position defining a limit of travel in a first pivotal direction and the second position defining a limit of travel in a second pivotal direction opposite the first pivotal direction; and an actuator control device, coupled to the at least one actuator.

2. The see-saw apparatus of claim 1, wherein:

the at least one actuator comprises a first linear actuator having one end coupled to the base and an opposite end coupled to the beam, in which extension or retraction of the linear actuator causes the beam to pivot in the first pivotal direction or the second pivotal direction.

3. The see-saw apparatus of claim 2, wherein the at least one first linear actuator is a pneumatic actuator.

4. The see-saw apparatus of claim 2, wherein the at least one first linear actuator is a hydraulic actuator.

5. The see-saw apparatus of claim 2, wherein the at least one actuator comprises at least a first linear actuator and a second linear actuator, the first linear actuator coupled between the base and a location on the beam between the fulcrum and the first end, and a second linear actuator coupled between the base and a location on the beam between the fulcrum and the second end, wherein the actuator control device is configured to cause simultaneous retraction of the first linear actuator and extension of the second linear actuator to cause the beam to pivot in the first pivotal direction and to cause simultaneous extension of the first linear actuator and retraction of the second linear actuator to cause the beam to pivot in the second pivotal direction.

6. The see-saw apparatus of claim 1, wherein the limit of travel in the first pivotal direction defines a configuration in which the first carrier platform floor is in planar alignment and contact with a ground surface and the limit of travel in the second pivotal direction defines a configuration in which the second carrier platform is in planar alignment and contact with the ground surface.

7. A see-saw apparatus, comprising:

a base;

a beam, having a first end and a second end, pivotally attached to the base at a fulcrum between the first end and the second end;

a first carrier platform, coupled to the first end of the beam, and configured to receive a wheelchair;

a second carrier platform, coupled to the second end of the beam, and configured to receive a wheelchair;

at least one actuator, coupled to the beam and the base, and configured to cause the beam to pivot between a first position and a second position, the first position defining a limit of travel in a first pivotal direction and the second position defining a limit of travel in a second pivotal direction opposite the first pivotal direction; and an actuator control device, coupled to the at least one actuator;

wherein the beam comprises a first longitudinal beam component and a second longitudinal beam component, with a plurality of beam cross-components connecting the first longitudinal beam component and the second longitudinal beam component, and the base comprises a first base side component and a second base side component, with a plurality of base cross-components connecting the first base side component and second base side component, wherein the at least one actuator is coupled to one of the plurality of base cross-components and to one of the plurality of beam cross-components.

8. The see saw apparatus of claim 7, further comprising a pivot shaft coupled to the beam and the base at the fulcrum.

9. The see saw apparatus of claim 8, wherein the pivot shaft has a first end coupled to a first bearing affixed to the base and a second end coupled to a second bearing affixed to the base.

* * * * *